United States Patent [19]

Iijima et al.

[11] 4,409,074

[45] Oct. 11, 1983

[54] PROCESS FOR ELECTROLYSIS OF AN AQUEOUS ALKALI METAL CHLORIDE SOLUTION

[75] Inventors: Tokuzo Iijima, Kobe; Yasushi Samejima, Kakogawa; Toshiji Kano; Yoshio Hatta, both of Kobe, all of Japan

[73] Assignee: Kanegafuchi Kagaku Kogyo Kabushiki Kaisha, Osaka, Japan

[21] Appl. No.: 256,569

[22] Filed: Apr. 22, 1981

[30] Foreign Application Priority Data

Jul. 28, 1980 [JP] Japan ..... 55-103804

[51] Int. Cl.[3] ..... C25B 1/34; C25B 1/46; C25B 9/00

[52] U.S. Cl. ..... 204/98; 204/128; 204/263; 204/266

[58] Field of Search ..... 204/98, 128, 266, 263

[56] References Cited

U.S. PATENT DOCUMENTS

| | | | |
|---|---|---|---|
| 3,242,059 | 3/1966 | Cottam et al. | 204/98 |
| 3,928,150 | 12/1975 | Rahn et al. | 204/98 |
| 4,100,050 | 7/1978 | Cook et al. | 204/98 |
| 4,253,922 | 3/1981 | Welch | 204/98 |
| 4,340,452 | 7/1982 | De Nora | 204/98 |

*Primary Examiner*—R. L. Andrews

*Attorney, Agent, or Firm*—Armstrong, Nikaido, Marmelstein & Kubovcik

[57] ABSTRACT

Disclosed is an electrolytic process of an aqueous alkali metal chloride solution using a cation exchange membrane as a separator of an electrolytic cell, which comprises effecting the electrolysis while utilizing impact resilience of springs positioned at anodes and exerting positive pressure on a cathode compartment of the cell. Not only is stable operation at low cell voltage for a prolonged period of time enabled, but also high purity alkali metal hydroxide containing a reduced amount of sodium chloride is produced.

9 Claims, No Drawings

PROCESS FOR ELECTROLYSIS OF AN AQUEOUS ALKALI METAL CHLORIDE SOLUTION

DETAILED DESCRIPTION OF THE INVENTION

The present invention relates to a new electrolysis process of an aqueous alkali metal chloride solution using a cation exchange membrane. More specifically, the present invention relates to a process for electrolysis utilizing impact resilience of springs positioned at anodes and exerting positive pressure on a cathode compartment of an electrolytic cell.

In a conventional ion-exchange membrane electrolysis process, the electrolysis is carried out by maintaining electrodes-cation exchange membrane spacing. The spacing disadvantageously increases cell voltage and thus a variety of studies and ingenuity have been centered on how to minimize the electrodes-cation exchange membrane spacing in a conventional ion exchange membrane process.

Notwithstanding, in a filter press type electrolytic cell in which cell frames are united with electrodes, cation exchange membranes are installed to and along the cell frames by way of packings (Gaskets) inserted so that a spacing between electrodes corresponding to the thickness of the packing is present to raise cell voltage. In cases where excessively thin packings are used to reduce the spacing, effective resiliency is lost to thus result in a reduced sealing effect. Moreover, in the case of an electrolytic cell having the finishing precision of about ±1 mm, an anode and a cathode, when pressed extremely, come in contact with each other partially to thereby result in a mechanical damage of a membrane. For this reason, it was difficult to reduce anod-cathode spacing to 3 mm or below in a conventional ion exchange membrane electrolysis.

It is an object of the present invention to provide an electrolytic process of an aqueous alkali metal chloride solution which effects the electrolysis while maintaining uniform anode-cathode spacing.

Another object of the present invention is to provide an electrolytic process of an aqueous alkali metal chloride solution which enables the electrolysis at low cell voltage.

Further object of the present invention is to provide an electrolytic process of an aqueous alkali metal chloride solution which produces high pure alkali metal hydroxide with a reduced content of impurities.

The present inventors have made a series of studies on an electrolysis process which is capable of reducing anode-cathode spacing to 5 mm or below, more preferably 3 mm or below and causes no mechanical damage of a membrane, and have completed the present invention.

That is, the present inventions is to provide an electrolysis process in which an anode having a spring is employed and the anode-cathode spacing is reduced by pressing the anode together with the membrane against the side of adjacent cathodes, and further, contacting and pressing force exerted between the membrane and the cathode is loosened by exerting positive pressure on a cathode compartment, thereby maintaining low voltage for a prolonged period of time without causing damage of the membrane.

Hereinafter, the present invention will be described in detail.

An anode especially suitable in the present invention is an expandable dimensionally stable-anode which is in wide use for an improved asbestos diaphragm process where an asbestos diaphragm reinforced with a fluorinated hydrocarbon resin (TAB or HAPP). The expandable dimensionally stable anode is suitably used in a finger type electrolytic cell but is also used in a filter press type electrolytic cell.

A cathode used in the present invention is not particularly limited and an ordinary one in its shape and material is employed. The shape of the cathode is, for example, a metal mesh, an expanded metal, a metal plate, a metal like a blind, a punching metal and the like, and the material is, for example, iron and an alloy thereof, nickel, a nickel plated metal and the like. The shape and the material are chosen optionally.

The pressing force against the cation exchange membrane by means of a spring is preferred in the range of from 0.01 to 10 kg per $cm^2$. When the anode with the finishing precision of about ±1 mm in its flatness is used, the anode may be satisfactorily brought into contact with the cation exchange membrane without damaging the membrane by the pressing force of 10 kg per $cm^2$ or below. The positive pressure exerted on the side of the cathode is preferred in the range of from 0.01 to 10 kg per $cm^2$, though varied depending upon the pressing force from the anode side. In cases where the positive pressure is in this range, mechanical damage of the membrane on the surface of the cathode may be prevented, even though the anode-cathode spacing is maintained to 3 mm or below, and a stable operation for a prolonged period of time is possible.

As a cation exchange membrane, there are included perfluorocarbon series membranes with an ion exchange group such as fulfonic acid group, carboxylic acid group, sulfonamide group and the like. Examples of the perfluorocarbon series cation exchange membrane are "Nafion" branded membranes which are produced and sold by E. I. Du Pont de Nemours & Company, including "Nafion #110", "#117", "#215", "#290", "#295" "#315", "#415", "#417", "#427" and the like. "Nafion #415" and "#417" are sulfonic acid type membranes, "#315" is a sulfonic acid type cation exchange membrane of a laminate type, "#215" and "#295" are cation exchange membranes having sulfonamide group on the cathode side and sulfonic acid group on the anode acid. These membranes are used for the electrolysis in a suitable concentration of sodium hydroxide (NaOH), respectively. It is especially preferred to use a membrane whose cathode side is denatured or laminated in thickness of from several microns to several tens microns and thus its performance is maintained by such treatment, because it is difficult to be damaged on its cathode side.

Exertion of positive pressure on the cathode side may be effected in various manners, selecting optionally from the height of anodic solution, the height of cathodic solution, negative pressure of anodic gas and/or positive pressure of cathodic gas. By the adjustment of these four kinds of pressure, the anode-cathode spacing may be, even during the course of operation, varied optionally to a desired distance. Maintenance of a certain spacing between membrane and cathode may also possible, if need be.

In accordance with the present invention, the anode-cathode spacing is maintained at a minimal distance so that cell voltage may be markedly lowered. Cell voltage in the present invention is lower by the range of from 0.1 to 0.6 V at anode current density of 25 A per $dm^2$ than in any conventional ion exchange membrane electrolysis.

Moreover, the present invention eminently improves the quality of product. For instance, when a sodium chloride (NaCl) solution is electrolysed under normal ion exchange membrane electrolysis conditions, NaCl content is reduced at anode density of 25 A per $dm^2$ to from 5 to 50 ppm in a sodium hydroxide liquor concentrated to 50%.

That is, the present invention not only enables the electrolysis at low cell voltage, but decreases content of an alkali metal chloride contained in an alkali metal hydroxide liquor produced.

In actually practicing the present invention by applying to a filter press type cell, an anode is installed to a current collecting bar from side and/or rear walls by means of a titanium spring. A spring may be optionally selected from a plate shape, a coil shape and the like, but the plate shape is preferred for the reason of electroconductivity of titanium. To the cell, is a cation exchange membrane positioned and then the anode is brought into contact with the membrane by the use of impact resilience of the spring, thereafter positive pressure being exerted on the cathode side using hydrogen pressure or head pressure resulting from the height of an aqueous alkali metal chloride solution.

In the case of a finger type electrolytic cell as well, an anode is installed similarly to a current collecting bar extending from bottom and side walls by means of a spring interposed at the anode. In this case, an expandable dimensionally stable anode used in the foregoing improved asbestos diaphragm process is advantageously employed and thus the present invention is particularly suitable for the finger type electrolytic cell. That is, the present invention enables the conversion of a conventional finger type asbestos diaphragm electrolytic cell to an ion exchange membrane electrolytic cell very feasibly by applying the present invention.

As finger type electrolytic cells used herein, there are included not only a finger type construction cell such as that described at page 93, *Chlorine Its Manufacture, Properties and Uses,* edited by J. S. Scone, issued by Reinhold Publishing Corporation, New York, 1962, but also a flattened tube type construction cell. Nowadays, the flattened tube type construction is also generally referred to as a finger type electrolytic cell. As alkali metals herein, there are included sodium, potassium and the like.

Hereinbelow, the present invention will be described in more detail by way of examples that follow, to which examples the scope of the present invention is not construed to be limited.

EXAMPLE 1

As an anode, an expandable dimensionally stable anode was served which made of expanded metal of titanium coated with titanium oxide-containing ruthenium oxide. A finger type cell was used providing a cathode which comprises punching metal of iron and a current collecting bar of copper. As a cation exchange membrane, a membrane obtained by converting a sulfonic acid type cation exchange membrane, "Nafion #417" to carboxylic acid on the thickness of 20μ of the cathode side thereof was formed cylindrically and then used. Cation exchange membrane installation frames made of titanium were positioned above and below a cathode box providing a plurality of cathodes, to which frames the cylindrical membranes were installed. The expandable dimensionally stable anodes were expanded so that average pressing force was substantially about 0.09 kg per $cm^2$ during the course of operation, then the brake pressure of 0.05 kg per $cm^2$ was exerted on a cathode compartment by the adjustment of the difference of head pressure of anodic and cathodic solution levels and pressure of anodic and cathodic gases. Into an anode compartment was an aqueous sodium chloride solution supplied, then electrolysed at anode current density of 25 A per $dm^2$. Even after operation for 30 days, no damage of membranes could be observed. The results obtained from 30 day operation were that NaCl content was 40 ppm in an obtained sodium hydroxide liquor calculated as 50% concentration with cell voltage of 3.5 V and current efficiency of 94%, under the conditions in which NaCl concentration of anodic solution was 3.5 N, temperature of anodic solution was 85° C. and NaOH concentration of cathodic solution (cell liquor) was 30%.

EXAMPLE 2

Experiment was conducted in a similar manner to that of Example 1, excepting that the pressing force was substantially maintained at about 0.05 kg per $cm^2$. An aqueous sodium chloride solution was charged into an anode compartment and electrolysed at anode current density of 25 A per $dm^2$. No damage of membranes was seen even after operation for 10 days. The obtained results were that under the conditions where NaCl concentration of anodic solution was 3.5 N, temperature of anodic solution was 85° C. and NaOH concentration of cathodic solution (cell liquor) was 30%, cell voltage was 3.7 V, current efficiency was 94% and NaCl content was 50 ppm in an obtained sodium hydroxide liquor calculated as 50% concentration.

COMPARATIVE EXAMPLE 1

Comparative experiment was carried out similarly to Example 1, with an exception that rod-shaped spacers having a dimeter of 1.5 mm were interposed at intervals of 100 mm between cation exchange membranes and cathodes. To an anode compartment was an aqueous sodium chloride solution introduced, then the electrolysis being effected at anode current of 25 A per $dm^2$. The results obtained from operation for 10 days were that under the conditions where NaCl concentration of anodic solution was 3.5 N, temperature of anodic solution was 85° C. and NaOH concentration of cathodic solution (cell liquor) was 30%, cell voltage was 3.7 V, current efficiency was 94% and NaCl content was 100 ppm in an obtained sodium hydroxide liquor calculated as 50% concentration.

What we claim is:

1. A process for electrolysis of an aqueous alkali metal chloride solution using a cation exchange membrane by which an electrolytic cell is partitioned into an anode compartment and a cathode compartment, which comprises effecting the electrolysis while utilizing impact resilience of springs positioned at anodes and exerting positive pressure on the cathode compartment.

2. The process of claim 1, wherein pressing force exerted on an anode side of the cation exchange membrane resulting from impact resilience of the springs is in the range of from 0.01 to 10 kg per $cm^2$.

3. The process of claim 1, wherein the positive pressure exerted on the cathode compartment is in the range of from 0.01 to 10 kg per $cm^2$.

4. The process of claim 1, wherein a means for exerting positive pressure on the cathode compartment is selected, singly or in combination, from anodic solution level, cathodic solution level, anodic gas negative pressure and cathodic gas positive pressure.

5. The process of claim 1, wherein the electrolysis is effected by substantially contacting the cation exchange membrane with the anode and maintaining cathode-cation exchange membrane spacing at 0 to 5 mm.

6. The process of claim 1, wherein the cathode-cation exchange membrane spacing is 0 to 3 mm.

7. The process of claim 1, wherein the anode is an expandable dimensionally stable anode.

8. The process of claim 1, wherein the electrolytic cell is a finger type electrolytic cell.

9. The process of claim 1, wherein the electrolysis is effected by utilizing the impact resilience of springs for pressing the anode together with the membrane positioned between the anode and cathode against the cathode for maintaining a reduced anode-cathode spacing, wherein the pressing force exerted between the membrane and the cathode is loosened by the positive pressure on the cathode.

* * * * *